United States Patent [19]

Ström

[11] 4,408,638

[45] Oct. 11, 1983

[54] FORMING FABRIC

[75] Inventor: Jan T. Ström, Gusum, Sweden

[73] Assignee: Gusums Bruk AB, Gusum, Sweden

[21] Appl. No.: 229,281

[22] Filed: Jan. 28, 1981

[30] Foreign Application Priority Data

Feb. 12, 1980 [SE] Sweden ..... 8001108

[51] Int. Cl.[3] ..... D03D 15/02

[52] U.S. Cl. ..... 139/425 A; 139/383 A; 162/DIG. 1; 428/257

[58] Field of Search ..... 139/383 A, 413, 425 A; 162/DIG. 1; 428/257

[56] References Cited

U.S. PATENT DOCUMENTS 4,071,050 1/1978 Codorniu ..... 139/425 A

*Primary Examiner*—James J. Bell

*Attorney, Agent, or Firm*—Holman & Stern

[57] ABSTRACT

The invention relates to a screen, which consists of one layer of longitudinal threads and one layer of transversal threads and which has a theoretical free area larger than 0%. The longitudinal threads (1) are drawn down in the fabric so that, in the drawn-down points, pockets, or cavities, (3) are formed between the bent-down points. Hereby the fabric or screen has a high draining capacity in combination with good retention properties.

5 Claims, 1 Drawing Figure

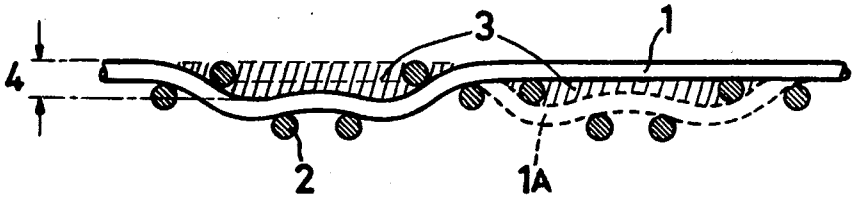
1
1A
3
2
4

FORMING FABRIC

BRIEF SUMMARY OF THE INVENTION

This invention relates to the form of a fabric or a screen, which consists of one layer of longitudinal, or weft threads and one layer of transversal, or warp, threads and which has a theoretical free area larger than 0%.

The object of the invention is to produce a screen, which has a high draining capacity in combination with good retention properties.

A screen which is better in these respects than known fabrics is characterized in that the longitudinal threads are drawn down in the fabric so that, in the drawn-down points, pockets, or cavities, are formed between the bent down points.

The known art teaches arranging the longitudinal threads of a one layer screen as straight as possible in order to reduce the tendency of extension of the screen in a paper machine. The tendency will not exist in the screen according to this invention particularly if the longitudinal threads are arranged close to each other in the screen produced by the transversal threads being of very highly shrinkable material having a larger diameter than the longitudinal threads, which should be relatively thin.

BRIEF DESCRIPTION OF THE DRAWING

An embodiment of the invention will now be described with reference to the drawing which shows a longitudinal section through a screen of a forming fabric of the one layer type of this invention.

DETAILED DESCRIPTION

A part of a longitudinal section through a screen can be seen from the drawing. One of the longitudinal, or weft, threads is denoted by 1 and the thread behind is denoted by 1A. The transversal, or warp, threads are denoted by 2. A certain inter-space volume exists normally, which means such a volume which is not occupied by threads. In the screen in the FIGURE, the inter-space volume has been increased by forming particular hollow pockets 3. These pockets are formed by the longitudinal or weft threads 1 and 1A intentionally being drawn down into the fabric. It should be pointed out that the thread 1A is shown only for better understanding. As used in this description, drawn down means that each weft thread 1 and 1A is passed down into the screen between two adjacent warp threads, over the next two warp threads 2 and up again between the next two warp threads, and then repeat, the weft threads being offset from the upper plane of the screen a distance 4 so that a cavity is formed between said bentdown points.

In order to reduce the tendency of the fabric to be extended in the paper machine, the longitudinal threads have been closely packed together in the screen by the transversal threads being of highly shrinkable material having a larger diameter than the longitudinal threads, which shall be comparatively thin. A screen made in this manner will not be extended more than conventional screens, which have straight longitudinal threads when the screen is completed.

The theoretical free area F of a screen can be calculated as a percent of the total area of the screen. The free area is the area which is not occupied by threads. The theoretical free area of the screen of this invention is greater than 0%, i.e., the actual area of the screen is larger than the total area of a projection of the threads onto a plane parallel with the screen. The so called interspace factor, or the degree of porosity P, can also be calculated for a screen. This factor is the interspace volume in percent of the total volume of the screen.

The quotient of the interspace factor and the theoretical free area (P/F) is similar to or greater than 4.9 for the screen shown in the FIGURE.

By keeping this quotient high one will get a screen having high draining capacity in combination with good retention properties.

The high draining capacity is achieved by making the screen so that a high degree of porosity is achieved. Screens according to the invention have a porosity which is greater than 60%. In order that the screen has the other characteristics according to the invention the free area should be less than or similar to 12.24%.

In order to compare the screen of this invention with four different conventional one-layer plastic screens, the following table is shown for four conventional screens.

| Binding | Free area % (F) | Porosity % (P) | Quotient P/F |
|---|---|---|---|
| 2-mounting | 25 | 50 | 2.00 |
| 3-mounting | 19 | 54 | 2.84 |
| 4-mounting | 21.5 | 60 | 2.79 |
| 5-mounting | 17 | 59 | 3.47 |

The known art teaches moving the longitudinal threads sideways, whereby airpockets are formed in the screen. This is another way to alter the interspace volume of a screen. Such a screen has not, however, a high draining capacity in combination with good retention properties of a degree comparable to that attained with this invention and calculations have shown that it is possible to achieve a factor P/F which is 4.77, which is a value below the one for 4.9 stated above. This shows, that a small change in the value of said quotient produces a much greater change in the qualities of the screen, which is achieved by this invention.

It has been said above that the longitudinal threads are drawn down in the screen and this can be done by using a certain technique in the weaving. It is also possible to pull down the longitudinal threads by shrinking the transversal threads, but it should be noticed that the invention is not limited to these two methods, since the longitudinal threads can be drawn down in other manners to produce the inventive idea as a result.

I claim:

1. Endless form of fabric or screen for paper making, wherein the fabric or screen consists of one layer of first threads extending in the longitudinal direction in which the fabric is moving in the machine and one layer of second threads extending in a direction transverse to said longitudinal direction, comprising said first threads being offset from the upper plane of the screen between two longitudinally spaced points, one of said points being the position where the said first threads are passed down between two adjacent second threads, the second of said points being the position where said first threads are passed up again between another two of said second threads, each of said first threads passing over at least two of said second threads between said points, whereby cavities are formed between said two points and the area of the screen is larger than the sum of the areas of a projection of the areas of the threads onto a plane parallel with the screen.

2. Screen according to claim 1 wherein the interspace factor, defined as the interspace volume in percent of the screen volume, divided by the free area of the screen in percent of said sum of the areas is at least 4.9.

3. Screen according to claim 2, wherein the interspace factor is at least 60%.

4. Screen according to any one of claims 1, 2 or 3, wherein said offset is at least 1.5 times the diameter of the first thread.

5. Screen according to claim 1, wherein the second threads are of highly shrinkable material and have a greater diameter than that of the first threads, so that upon shrinking of the second threads after the screen has been woven the first threads are packed close together.

* * * * *